US010384371B2

(12) United States Patent
Oh

(10) Patent No.: US 10,384,371 B2
(45) Date of Patent: Aug. 20, 2019

(54) METHOD FOR MANUFACTURING MULTI-SIDED CONTINUOUS PATTERNED STONE PANEL

(71) Applicant: Gun Jae Oh, Anyang-si (KR)

(72) Inventor: Gun Jae Oh, Anyang-si (KR)

( * ) Notice: Subject to any disclaimer, the term of this patent is extended or adjusted under 35 U.S.C. 154(b) by 165 days.

(21) Appl. No.: 15/575,341

(22) PCT Filed: Nov. 6, 2015

(86) PCT No.: PCT/KR2015/011871
§ 371 (c)(1),
(2) Date: Nov. 17, 2017

(87) PCT Pub. No.: WO2016/190497
PCT Pub. Date: Dec. 1, 2016

(65) Prior Publication Data

US 2018/0154553 A1 Jun. 7, 2018

(30) Foreign Application Priority Data

May 28, 2015 (KR) ..... 10-2015-0074655

(51) Int. Cl.
*B28D 1/22* (2006.01)
*B26F 3/00* (2006.01)

(52) U.S. Cl.
CPC ..... *B28D 1/22* (2013.01); *B26F 3/00* (2013.01); *B26F 3/004* (2013.01)

(58) Field of Classification Search
CPC ..... B24B 37/08; B24B 37/28; B28D 1/225; B28D 1/22; B26F 3/00; B26F 3/004
USPC ..... 451/23.01
See application file for complete search history.

(56) References Cited

U.S. PATENT DOCUMENTS 1,716,991 A * 6/1929 Turner ..... B26D 1/09 125/23.01
2,194,980 A * 3/1940 Knapp ..... C09C 1/52 125/23.01
4,088,112 A * 5/1978 Hight, Jr. ..... B28B 1/084 125/2

(Continued)

FOREIGN PATENT DOCUMENTS

KR 20-0340931 Y1 2/2004
KR 10-0676753 B1 2/2007

(Continued)

*Primary Examiner* — George B Nguyen
(74) *Attorney, Agent, or Firm* — KORUS Patent, LLC; Seong Il Jeong

(57) ABSTRACT

A method for manufacturing a multi-sided continuously patterned stone panel according to the present invention includes: cutting out stripes (116) in which continuous linear patterns are formed on both sides thereof by cutting an original plate (110) along successively repeated linear paths (continuous linear patterns) (112) while moving a water jet device (120) in a vertical direction; separating the separate stripes (116), and loading each of the separate stripes (116) on a lateral cutting device (130); and cutting out multi-sided continuously patterned stone panel products in which continuous linear patterns are formed on both sides thereof and remaining two sides thereof are cut in rectilinear lines by cutting the stripe (116) with a blade cutter (134), installed on a frame (132) of a lateral cutting device (130), in rectilinear lines in a lateral direction.

2 Claims, 10 Drawing Sheets

(56) References Cited

U.S. PATENT DOCUMENTS

| | | | | |
|---|---|---|---|---|
| 5,042,339 | A * | 8/1991 | Gerber | B26D 5/005 83/49 |
| 5,605,141 | A * | 2/1997 | Bilotta | B28D 1/005 125/16.02 |
| 7,489,984 | B2 * | 2/2009 | Jackman | B24C 1/045 125/1 |
| 7,748,373 | B2 * | 7/2010 | Toncelli | B28D 1/043 125/35 |
| 7,774,091 | B2 * | 8/2010 | Jackman | B24C 1/045 125/1 |
| 9,104,191 | B2 * | 8/2015 | Lee | B23K 26/0604 |
| 9,886,019 | B2 * | 2/2018 | Toncelli | G05B 19/18 |
| 2006/0135041 | A1 * | 6/2006 | Boone | B24C 1/045 451/5 |
| 2009/0013839 | A1 * | 1/2009 | Kanai | B24C 1/00 83/13 |
| 2010/0236371 | A1 * | 9/2010 | Lee | B23K 26/38 83/651 |
| 2013/0213200 | A1 * | 8/2013 | Cooper | B26F 3/004 83/23 |
| 2013/0313301 | A1 * | 11/2013 | Brown | C03B 33/023 225/2 |
| 2016/0039048 | A1 * | 2/2016 | Giguere | B24C 1/045 219/121.44 |

FOREIGN PATENT DOCUMENTS

| | | | |
|---|---|---|---|
| KR | 10-0947069 | B1 | 3/2010 |
| KR | 10-0960307 | B1 | 6/2010 |
| KR | 10-1312221 | B1 | 9/2013 |

* cited by examiner

METHOD FOR MANUFACTURING MULTI-SIDED CONTINUOUS PATTERNED STONE PANEL

TECHNICAL FIELD

The present invention relates to a method for manufacturing a multi-sided continuously patterned stone panel, which is configured to produce products from a construction stone panel (a granite stone panel, a marble panel, an artificial stone panel, an engineered stone panel, or the like) through "separate processes" including a vertical cutting process for continuous linear patterns and a lateral cutting process for rectilinear lines.

BACKGROUND ART

Korean Patent No. 10-1312221 (registered on Sep. 17, 2013) discloses a "water jet spray nozzle, a water jet system, and a method for controlling the water jet system."

The water jet system is configured to include: a spray nozzle configured such that the sectional shape of an end thereof through which water is sprayed is elliptical; a spray nozzle support configured such that the spray nozzle is fixedly mounted on the front end thereof and a path through which water to be supplied to the spray nozzle passes is formed therein; a driven bevel gear configured to be mounted on the outside surface of the spray nozzle; a driving bevel gear configured to engage with the gear of the driven bevel gear; a servo-motor configured to be coupled with the driving bevel gear, and to rotate the driving bevel gear; and a control unit configured to control the driving of the servo-motor. The control unit controls the direction of rotation in which the spray nozzle is rotated in accordance with the direction of the movement of the spray nozzle. A groove wider than a groove formed by a conventional circular nozzle is allowed to be formed when a pattern is formed on the surface of a stone panel, and the width of a groove to be formed on the stone panel is adjusted by adjusting the angle of the nozzle through the rotation of the nozzle.

However, the water jet system does not disclose a method of cutting out a multi-sided continuously patterned stone panel.

Referring to FIGS. 1 and 2, the conventional method for manufacturing a multi-sided (multi-straight sided or multi-curved sided) stone panel is a nesting machining method using a water jet, and cuts a multi-sided stone panel, such as the multi-straight sided stone panel 3 of FIG. 1 or the multi-curved sided stone panel 5 of FIG. 2, out of an original stone plate 1 according to the shape thereof individually.

In other words, a nesting machining method using a water jet is configured to cut out a multi-sided stone panel individually by using a dual machining method in which vertical cutting and lateral cutting are combined with each other.

However, the above-described conventional method for manufacturing a multi-sided stone panel has a machining speed of 0.3 meters per minute in the case of granite stone having a thickness of 20 mm, requires a long machining time, has a high defect rate because a corner is easily damaged during cornering work, generates a large quantity of remnants (scraps) after the machining of a multi-sided stone panel, and has a small product market due to the high cost and low efficiency thereof.

DISCLOSURE

Technical Problem

Accordingly, an object of the present invention is to provide a method for manufacturing a multi-sided continuously patterned stone panel, which is configured to produce products through "separate processes" including a vertical cutting process for continuous linear patterns and a lateral cutting process for rectilinear lines, so that: cutting time can be reduced; loading and unloading can be rapidly and easily performed, and thus a vertical cutting device and a lateral cutting device can be selectively operated in automatic, semiautomatic, and manual manners and various work systems, such as the division of work, can be utilized according to production conditions; mass production can be performed; and the generation of remnants (scraps) can be minimized.

Technical Solution

In order to accomplish the above object, an example of a method for manufacturing a multi-sided continuously patterned stone panel according to the present invention includes:

cutting out stripes in which continuous linear patterns are formed on both sides thereof by cutting an original plate along successively repeated linear paths (continuous linear patterns) while moving a water jet device in a vertical direction; and cutting out multi-sided continuously patterned stone panel products in which continuous linear patterns are formed on both sides thereof and the remaining two sides thereof are cut in rectilinear lines by cutting the stripe with a blade cutter, installed on the frame of a lateral cutting device, in rectilinear lines in a lateral direction.

Another example of a method for manufacturing a multi-sided continuously patterned stone panel according to the present invention includes:

cutting out a plurality of stripes in which continuous linear patterns are formed on both sides thereof by arranging a plurality of water jet devices on the hanger frame of a vertical cutting device at predetermined intervals and allowing the water jet devices to perform cutting along successively repeated linear paths (continuous linear patterns) while moving the hanger frame in a vertical direction; and cutting out multi-sided continuously patterned stone panel products in which continuous linear patterns are formed on both sides thereof and the remaining two sides thereof are cut in rectilinear lines by arranging a plurality of blade cutters on the frame of a lateral cutting device at set intervals and allowing the plurality of blade cutters to cut the stripe in rectilinear lines in a lateral direction.

Advantageous Effects

Accordingly, the method for manufacturing a multi-sided continuously patterned stone panel according to the present invention is configured to produce products through "separate processes" including the vertical cutting process for the continuous linear patterns and the lateral cutting process for the rectilinear lines, so that advantages arise in that: cutting time can be reduced; loading and unloading can be rapidly and easily performed, and thus the vertical cutting device and the lateral cutting device can be selectively operated in automatic, semiautomatic, and manual manners and various work systems, such as the division of work, can be utilized according to production conditions; mass production can be performed; cornering work is not performed, and thus the occurrence of defective products can be considerably reduced; and the generation of remnants (scraps) can be minimized.

MODE FOR INVENTION

Embodiments of the present invention will be described in detail below with reference to the accompanying drawings.

Figure 1:
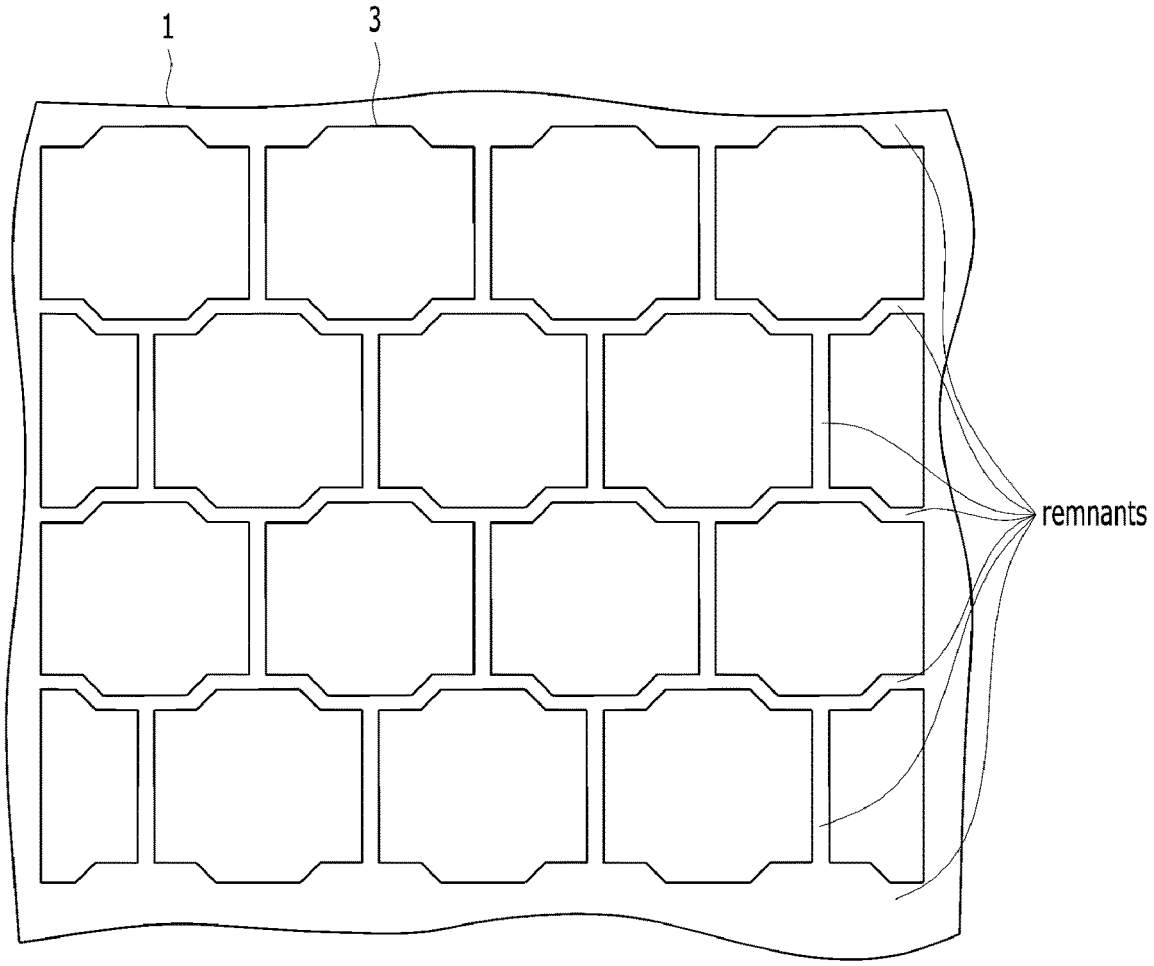
FIG. 1 is a schematic diagram showing an example of cutting a multi-straight sided stone panel out of an original plate stone panel by using a conventional nesting machining method using water jet.
Figure 2:
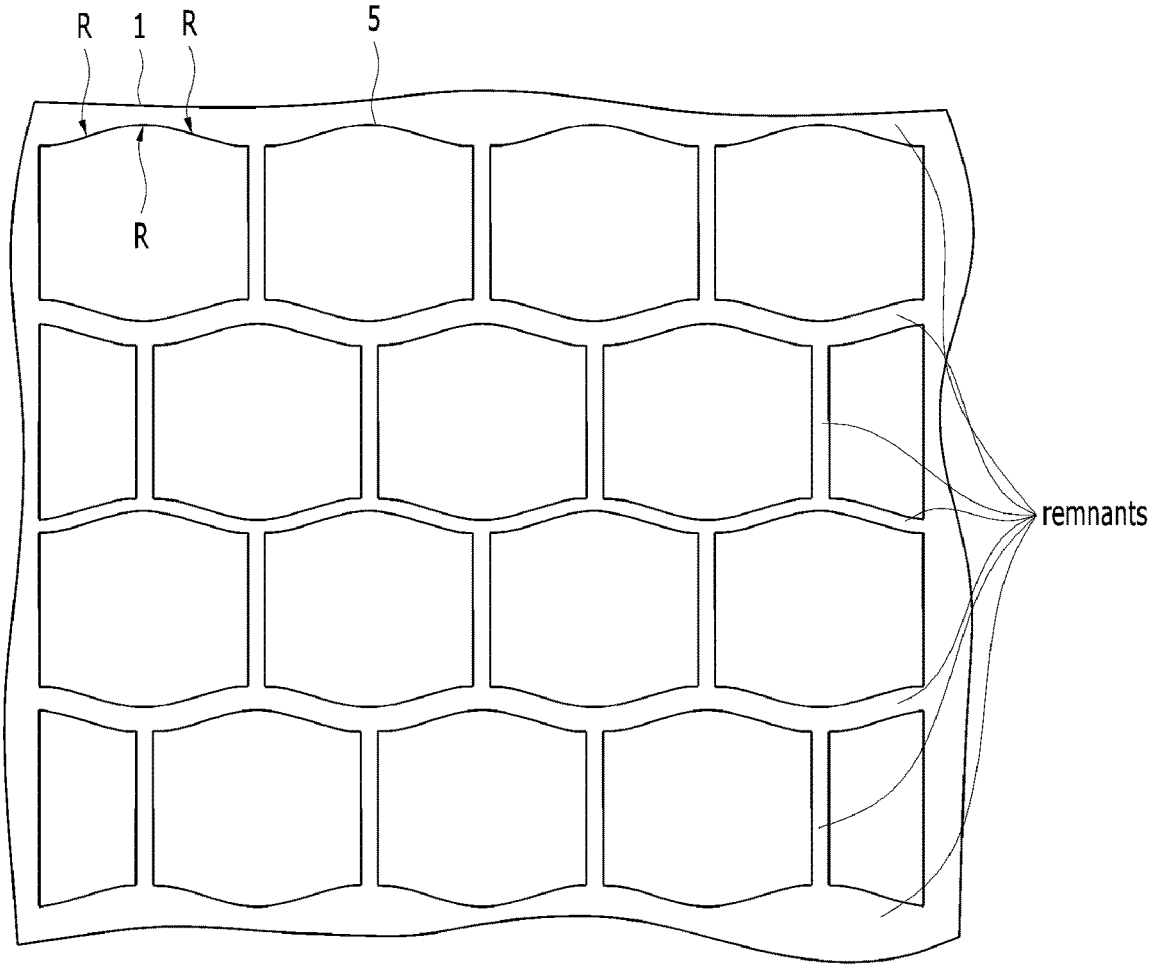
FIG. 2 is a schematic diagram showing an example of cutting a multi-curved sided stone panel out of an original plate stone panel by using a conventional nesting machining method using water jet.
Figure 3:
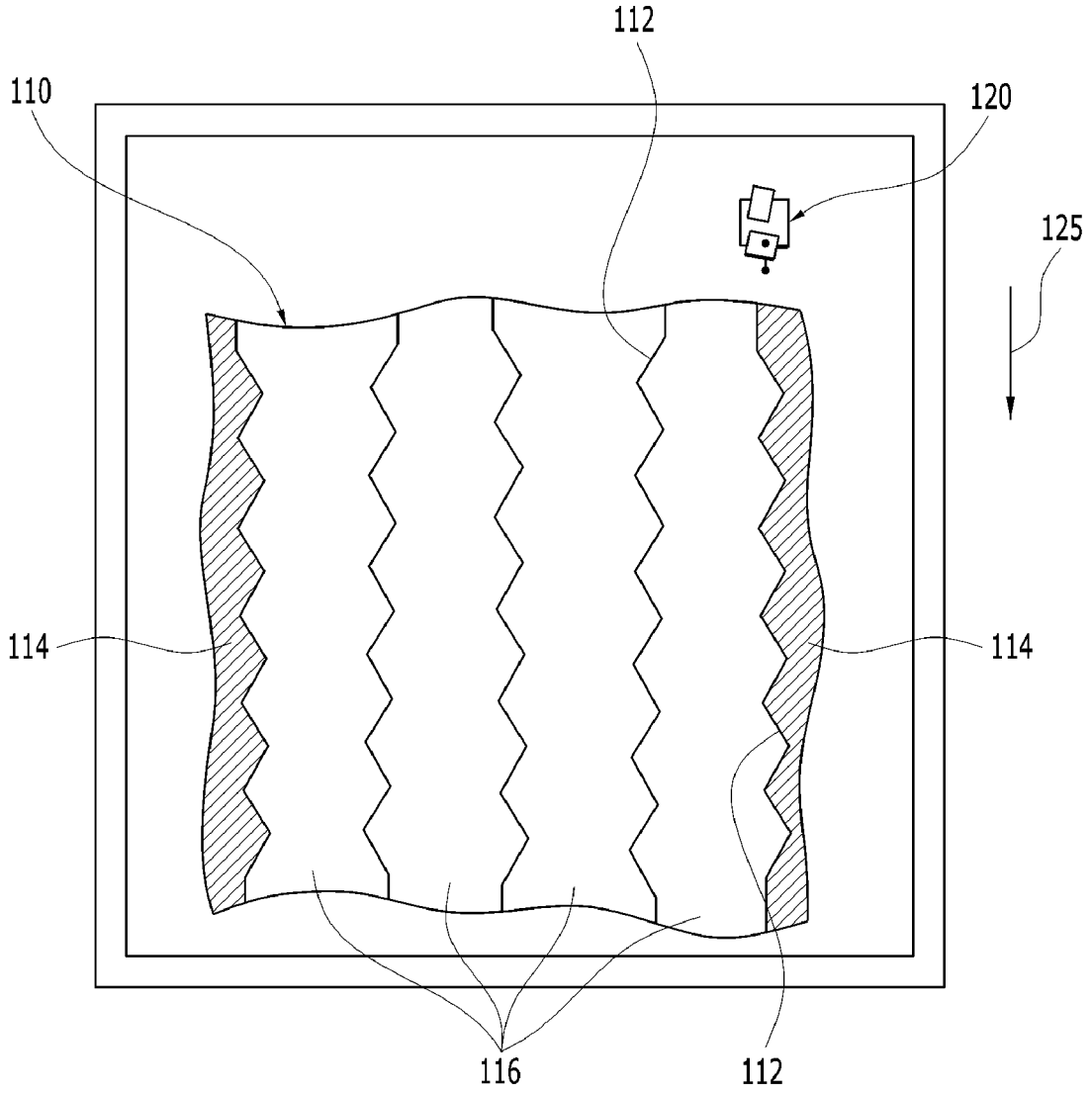
FIGS. 3 and 4 are schematic diagrams illustrating the vertical cutting process and lateral cutting process of a method for manufacturing a multi-sided continuously patterned stone panel according to a second embodiment of the present invention.
Figure 4:
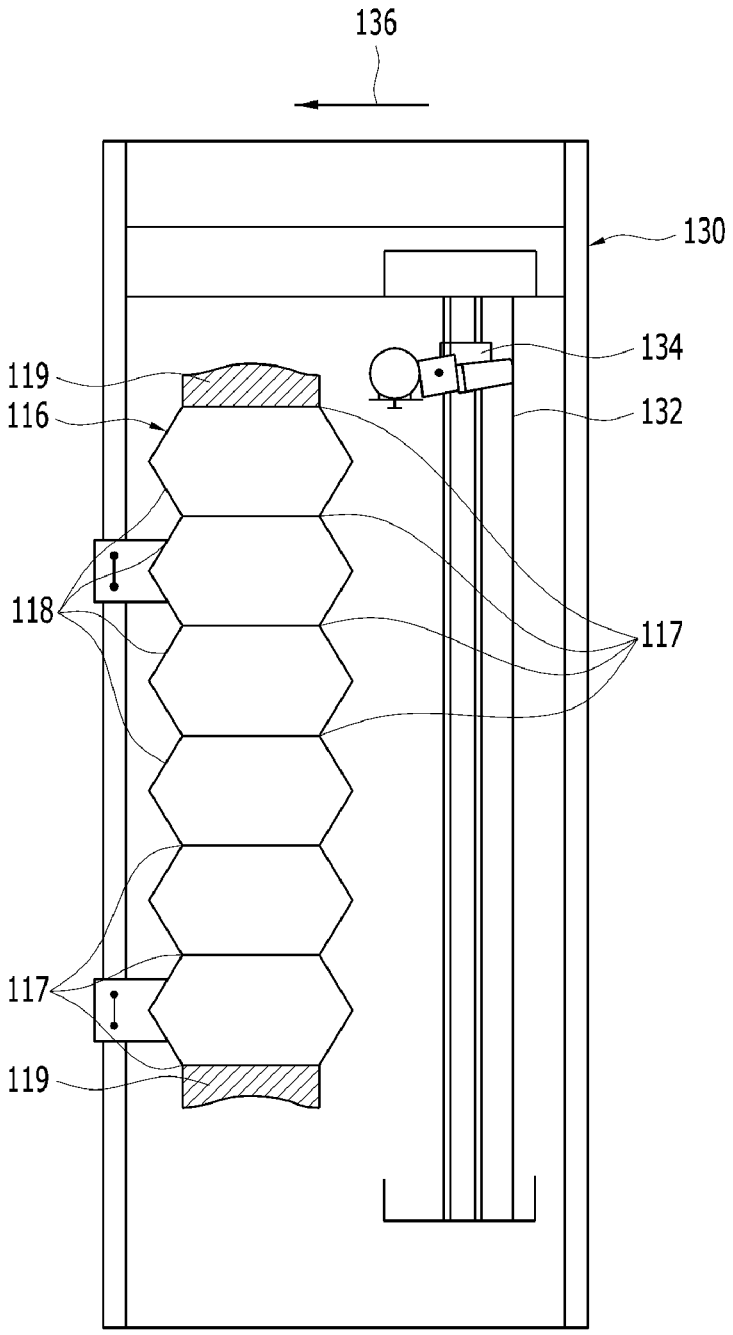

Referring to FIGS. 3 and 4, a method for manufacturing a multi-sided continuously patterned stone panel according to a first embodiment of the present invention is as follows:

As shown in FIG. 3, an original plate 110 is cut along successively repeated linear paths 112 (continuous linear patterns) while moving a water jet device 120 in a vertical direction, such as the direction of an arrow 125.

In this case, the present invention is configured to repeatedly cut the original plate 110 with the single water jet device 120 along the successively repeated linear paths 112 (the continuous linear patterns) at regular intervals in the vertical direction.

Through the above operation, a plurality of stripes 116 in which continuous linear patterns are formed on both sides of the original stone plate 110 shown in FIG. 3 is cut out. In this case, remnants 114 (scraps) are generated only at the left and right side ends of the original stone plate 110 having a large area.

Referring to FIG. 4, thereafter, each of the stripes 116 is cut with a blade cutter 134 mounted on the frame 132 of a lateral cutting device 130 in rectilinear lines in a lateral direction, such as the direction of an arrow 136 in FIG. 4.

In this case, the present invention is configured to repeatedly cut the stripe 116 with the single blade cutter 134 in rectilinear lines at regular intervals in a lateral direction.

Through the above operation, a plurality of multi-sided continuously patterned stone panel products 118 in which continuous linear patterns are formed on both sides of the stripe 116 shown in FIG. 4 and the remaining two sides thereof are cut in rectilinear lines are cut out, and remnants 119 (scraps) are generated only at both side ends of the stripe 116.

Figure 5:
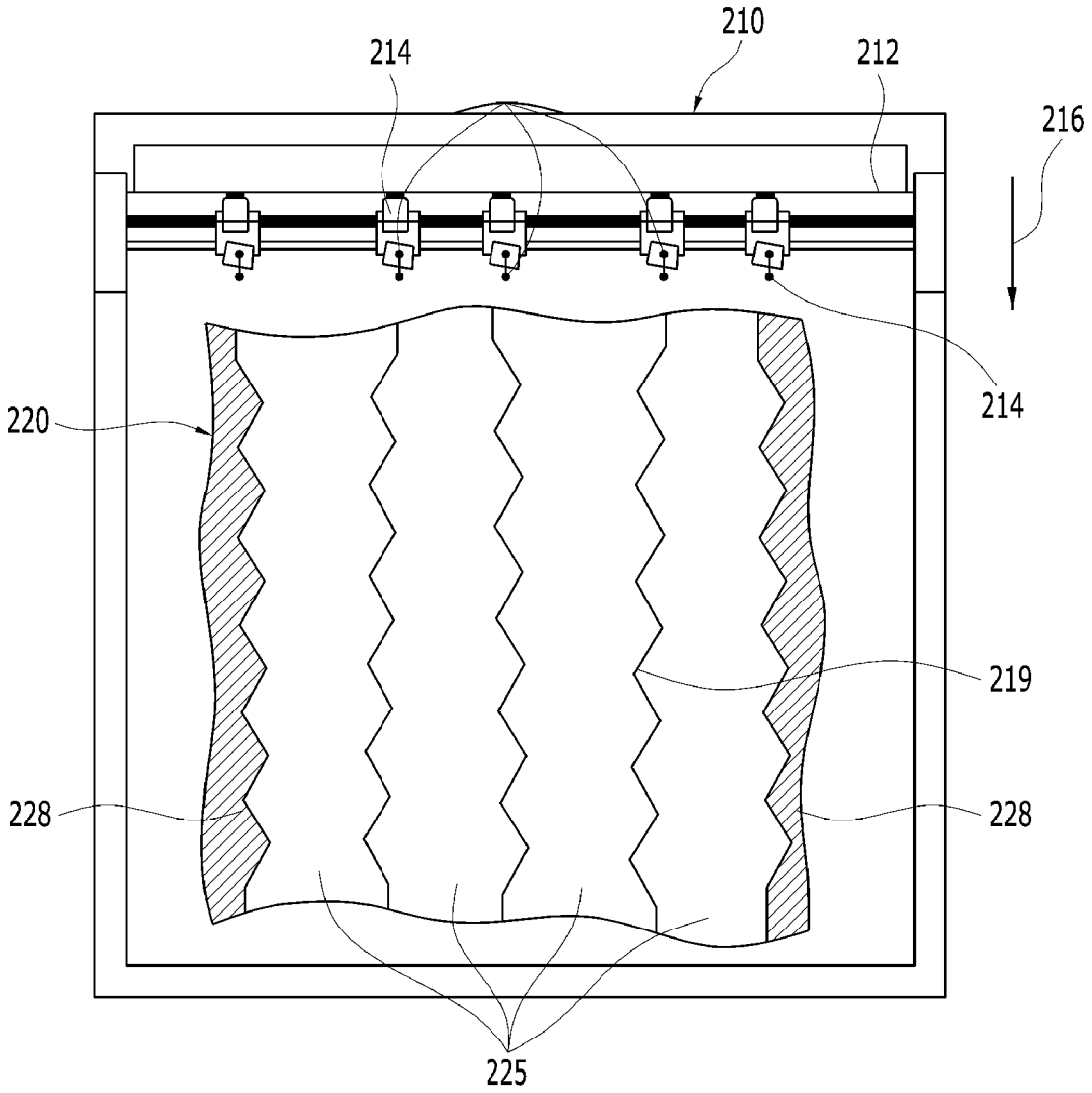
FIGS. 5 and 6 are schematic diagrams illustrating the vertical cutting process and lateral cutting process of a method for manufacturing a multi-sided continuously patterned stone panel according to a second embodiment of the present invention.
Figure 6:
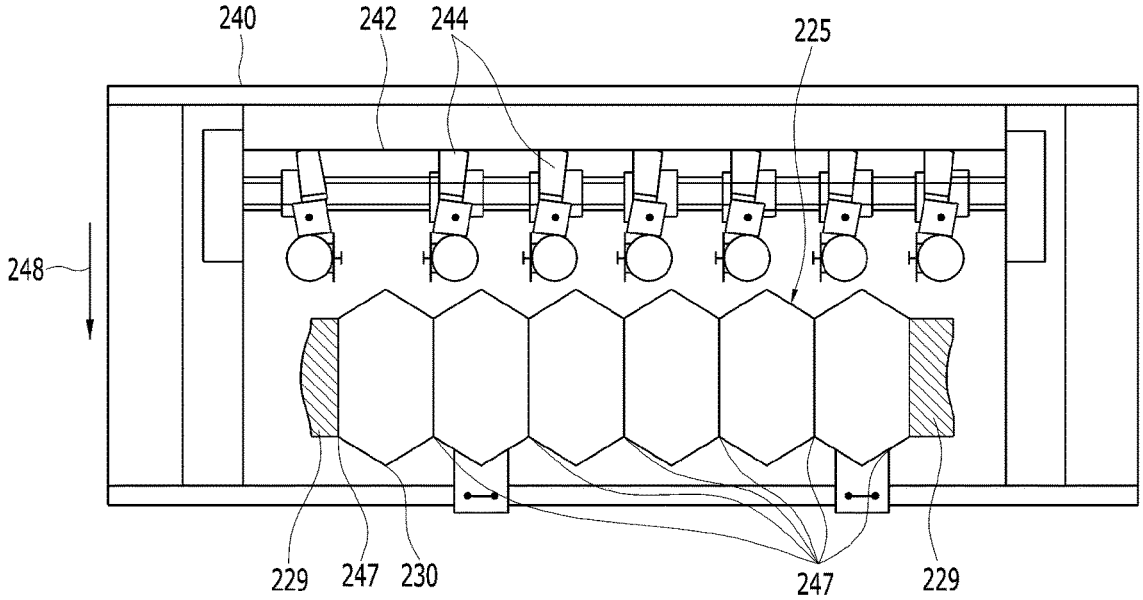

Referring to FIGS. 5 and 6, a method for manufacturing a multi-sided continuously patterned stone panel according to a second embodiment of the present invention is as follows:

As shown in FIG. 5, a plurality of water jet devices 214 are arranged along the hanger frame 212 of a vertical cutting device 210 at predetermined intervals, and the respective water jet devices 214 perform cutting along successively repeated linear paths 219 (continuous linear patterns) at the same time that the hanger frame 212 is moved along a vertical direction, such as the direction of an arrow 216.

Through the above operation, a plurality of stripes 225 in which continuous linear patterns are formed on both sides of the original stone plate 220 shown in FIG. 5 is cut out. In this case, remnants 228 (scraps) are generated only at left and right side ends of the original stone plate 20 having a large area.

Referring to FIG. 6, thereafter, a plurality of blade cutters 244 is arranged along the frame 242 of a lateral cutting device 240 at set intervals, and the plurality of blade cutters 244 cuts each of the stripes 225 in rectilinear lines in a lateral direction, such as the direction of an arrow 246 in FIG. 4. Accordingly, a plurality of multi-sided continuously patterned stone panel products 230 in which continuous linear patterns are formed on both sides thereof and the remaining two sides thereof are cut in rectilinear lines is cut out, and remnants 229 (scraps) are generated only at both side ends of the stripe 225.

In the above-described methods for manufacturing a multi-sided continuously patterned stone panel according to the first and second embodiments of the present invention, the configurations of the vertical cutting devices, the water jet devices, and the lateral cutting devices are already well known, and thus detailed descriptions thereof are omitted herein.

The above-described method for manufacturing a multi-sided continuously patterned stone panel according to the present invention is configured to produce products through "separate processes" including the vertical cutting process for the continuous linear patterns and the lateral cutting process for the rectilinear lines. Accordingly, cutting time can be reduced. Loading and unloading can be rapidly and easily performed, and thus the vertical cutting device and the lateral cutting device can be selectively operated in automatic, semiautomatic, and manual manners and various work systems, such as the division of work, can be utilized according to production conditions. Mass production can be performed. Cornering work is not performed, and thus corners of products can be prevented from being damaged and causing defects. The generation of remnants (scraps) can be minimized.

Figure 7A:
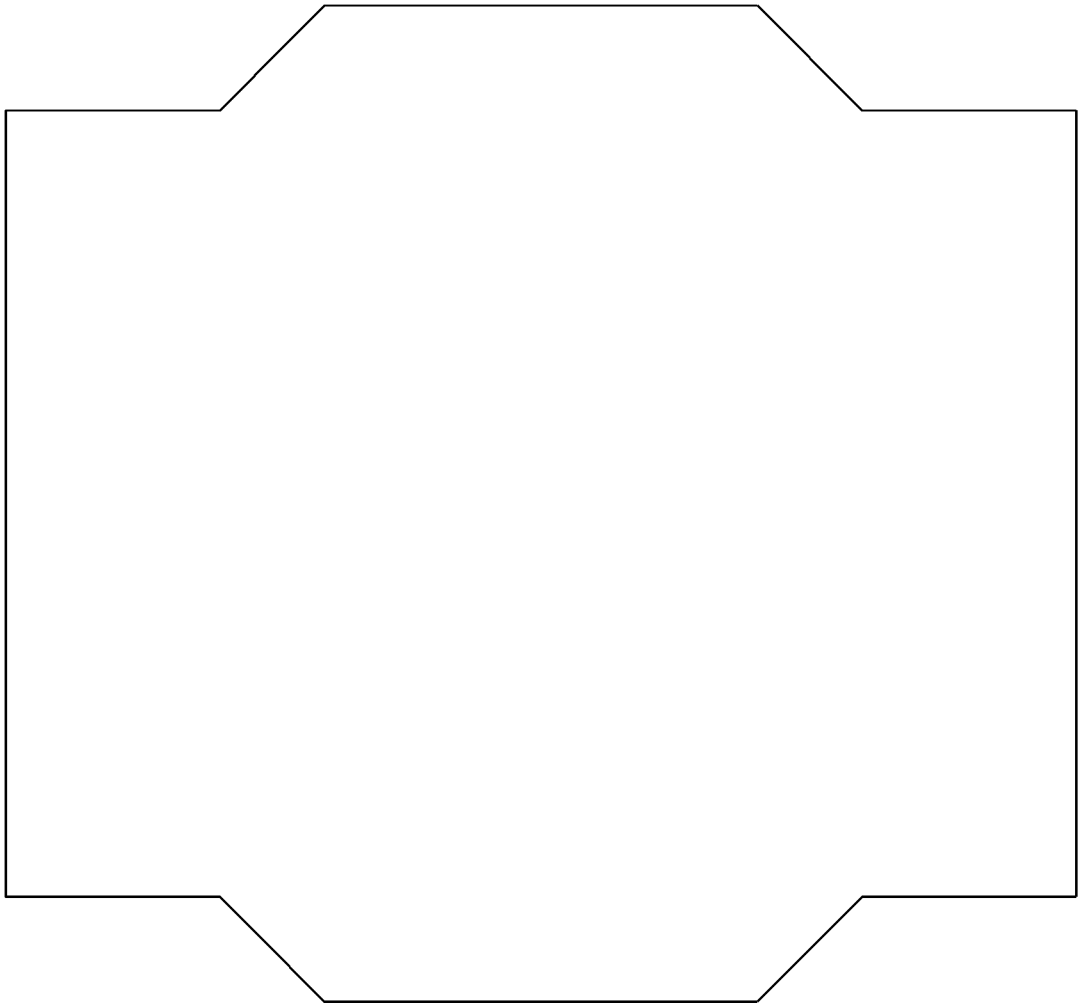
FIGS. 7*a* to 7*f* are schematic diagrams showing respective multi-sided continuously patterned stone panel products manufactured by the method for manufacturing a multi-sided continuously patterned stone panel according to the present invention.
Figure 7B:
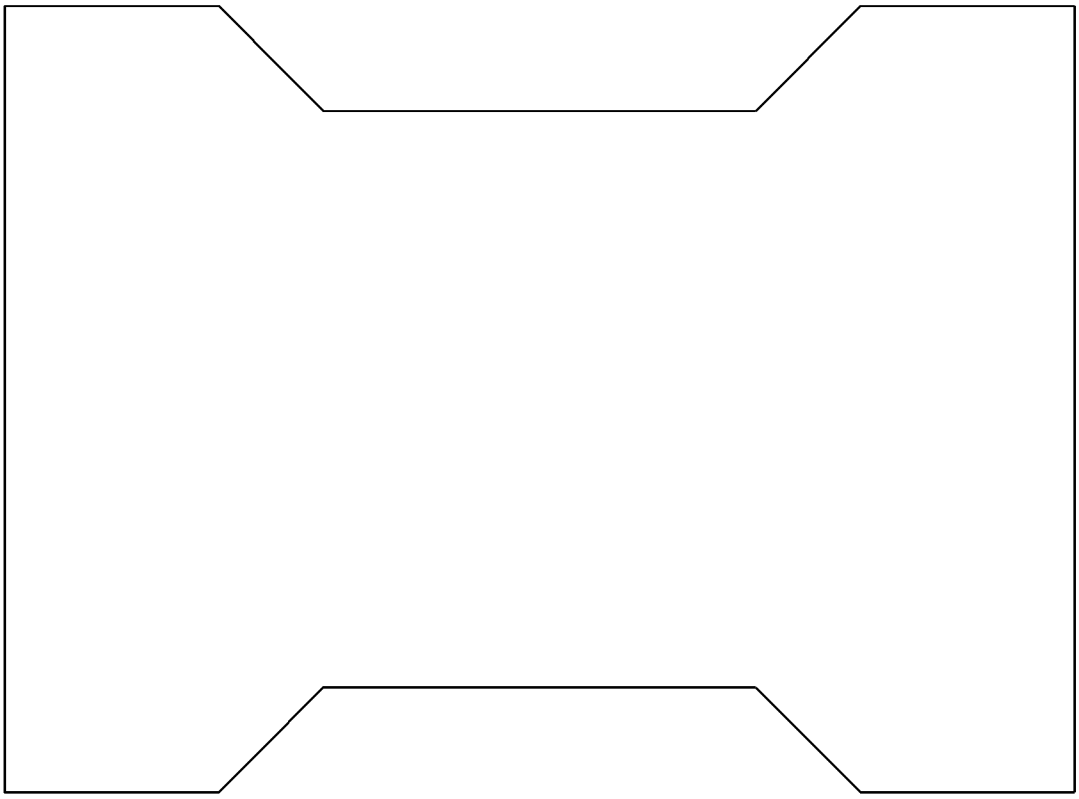
Figure 7C:
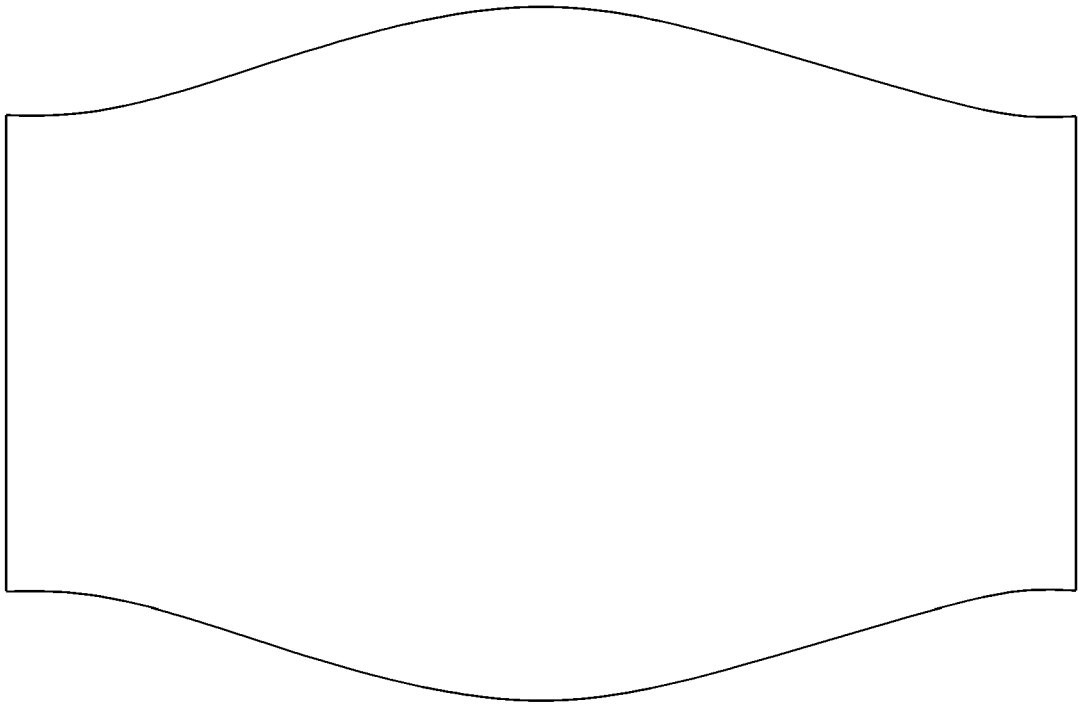
Figure 7D:
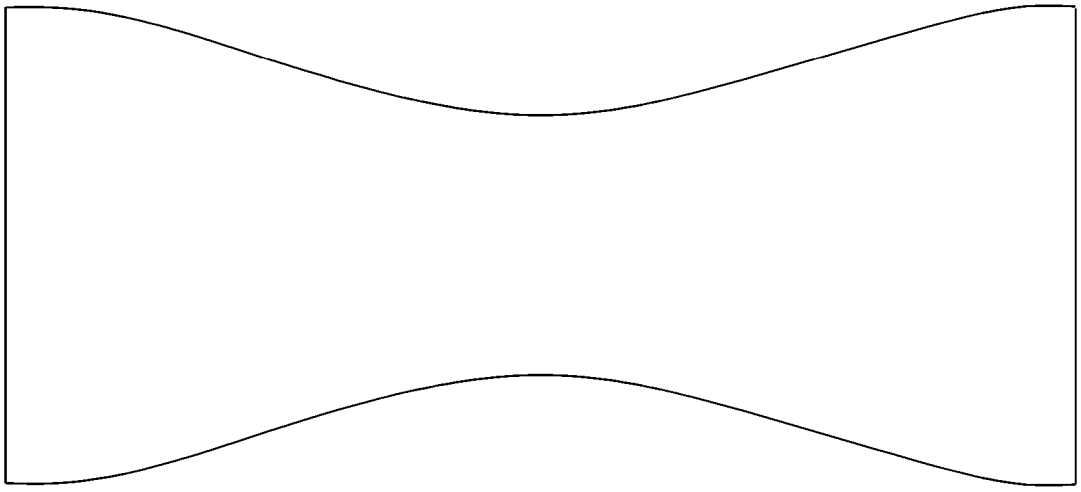
Figure 7E:
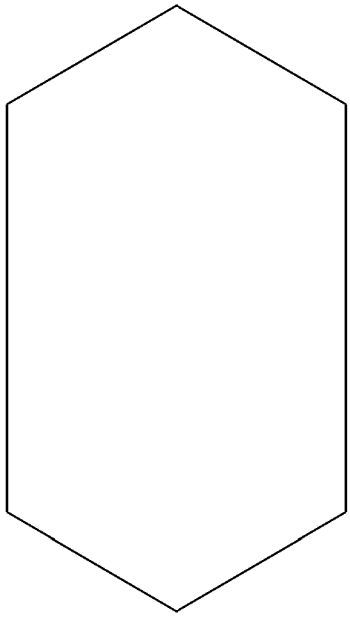
Figure 7F:
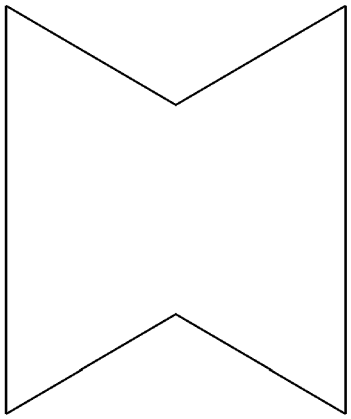

Furthermore, the multi-sided continuously patterned stone panel manufactured by the above-described manufacturing method may be any one of a convex line-shaped multi-sided panel, such as that shown in FIG. 7*a*, a concave line-shaped multi-sided panel shown in FIG. 7*b*, a convex curve-shaped multi-sided panel, such as that shown in FIG. 7*c*, a concave curve-shaped multi-sided panel, such as that shown in FIG. 7*d*, a convex six-sided panel shown in FIG. 7*e*, and a concave six-sided panel, such as that shown in FIG. 7*f*.

The invention claimed is:

1. A method for manufacturing a multi-sided continuously patterned stone panel, the method comprising:

cutting out stripes (116) in which continuous linear patterns are formed on both sides thereof by cutting an original plate (110) along successively repeated linear paths (continuous linear patterns) (112) while moving a water jet device (120) in a vertical direction;

separating the separate stripes (116), and loading each of the separate stripes (116) on a lateral cutting device (130); and cutting out multi-sided continuously patterned stone panel products in which continuous linear patterns are formed on both sides thereof and remaining two sides thereof are cut in rectilinear lines by cutting the stripe (116) with a blade cutter (134), installed on a frame (132) of the lateral cutting device (130), in rectilinear lines in a lateral direction.

2. A method for manufacturing a multi-sided continuously patterned stone panel, the method comprising:

cutting out a plurality of stripes (225) in which continuous linear patterns are formed on both sides thereof by arranging a plurality of water jet devices (214) on a hanger frame (212) of a vertical cutting device (210) at predetermined intervals and allowing the water jet devices (214) to perform cutting along successively repeated linear paths (continuous linear patterns) (219) while moving the hanger frame (212) in a vertical direction;

separating the stripes (255), and loading each of the separate stripes (255) on a lateral cutting device (240); and cutting out multi-sided continuously patterned stone panel products in which continuous linear patterns are formed on both sides thereof and remaining two sides thereof are cut in rectilinear lines by arranging a plurality of blade cutters (244) on a frame (242) of the lateral cutting device (240) at set intervals and allowing the plurality of blade cutters (244) to cut the stripe (225) in rectilinear lines in a lateral direction.

* * * * *